US005224890A

United States Patent [19]

Moran

[11] Patent Number: 5,224,890

[45] Date of Patent: * Jul. 6, 1993

[54] BODYBOARD WITH VARIABLE STIFFNESS

[75] Inventor: Steven M. Moran, Long Beach, Calif.

[73] Assignee: Kransco, San Francisco, Calif.

[ * ] Notice: The portion of the term of this patent subsequent to May 19, 2009 has been disclaimed.

[21] Appl. No.: 642,236

[22] Filed: Jan. 16, 1991

Related U.S. Application Data

[63] Continuation-in-part of Ser. No. 638,835, Jan. 4, 1991, Pat. No. 5,114,370.

[51] Int. Cl.[5] ..... A63C 15/00

[52] U.S. Cl. ..... 441/65; 114/357

[58] Field of Search ..... 441/65, 68, 74, 79; 114/357; D21/228; 280/610; 428/71, 73

[56] References Cited

U.S. PATENT DOCUMENTS

| | | | |
|---|---|---|---|
| 3,326,564 | 6/1967 | Heuvel | 280/11.3 |
| 3,414,919 | 12/1968 | Gust | 441/74 |
| 3,514,798 | 6/1970 | Ellis | 441/74 |
| 3,543,315 | 12/1970 | Hoffman | 441/74 |
| 3,776,563 | 12/1973 | Tigert | 280/11.3 |
| 4,071,264 | 1/1978 | Legrand et al. | 280/610 |
| 4,209,867 | 7/1980 | Abrams, III | 441/74 |
| 4,297,796 | 11/1981 | Stirtz et al. | 36/28 |
| 4,848,786 | 7/1989 | Mankau | 280/602 |
| 5,114,370 | 5/1992 | Moran | 441/65 |

FOREIGN PATENT DOCUMENTS

| | | | |
|---|---|---|---|
| 3019535 | 11/1981 | Fed. Rep. of Germany | 441/74 |
| 3839805 | 5/1990 | Fed. Rep. of Germany | 441/74 |

*Primary Examiner*—Edwin L. Swinehart
*Attorney, Agent, or Firm*—Kolisch, Hartwell, Dickinson, McCormack & Heuser

[57] ABSTRACT

A bodyboard is provided which incorporates selected regions of differing stiffness in order to combine in one board the speed associated with relatively stiff bodyboards and the maneuverability of soft bodyboards. Laminated into the layered structure of the bodyboard is a fiber mesh which has a size and orientation designed to stiffen the rear four-fifths of the bodyboard. The remainder of the board, adjacent the nose, incorporates a pattern of parallel arcuate channels which increase the bendability of the nose portion of the board. Because the board is stiff in the region supporting most of the weight of the rider, it has less drag than soft bodyboards and is fast. The flexibility in the nose area enhances maneuverability. The design of the reinforcing mesh and the bendability-enhancing nose inhibits the formation of permanent creases and allows the board to retain the overall general appearance and internal laminated structure of prior art bodyboards.

17 Claims, 4 Drawing Sheets

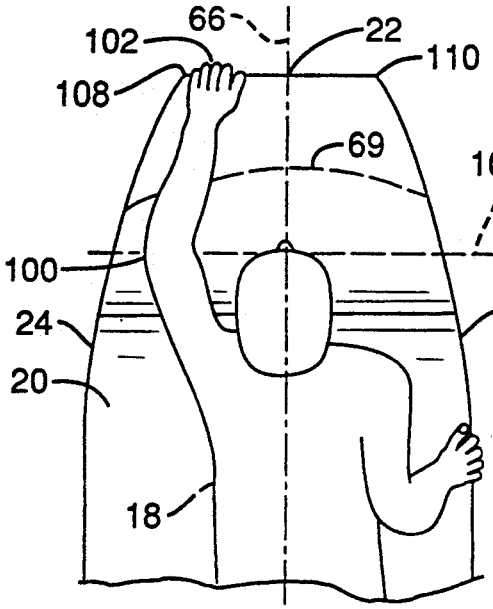
FIG. 8
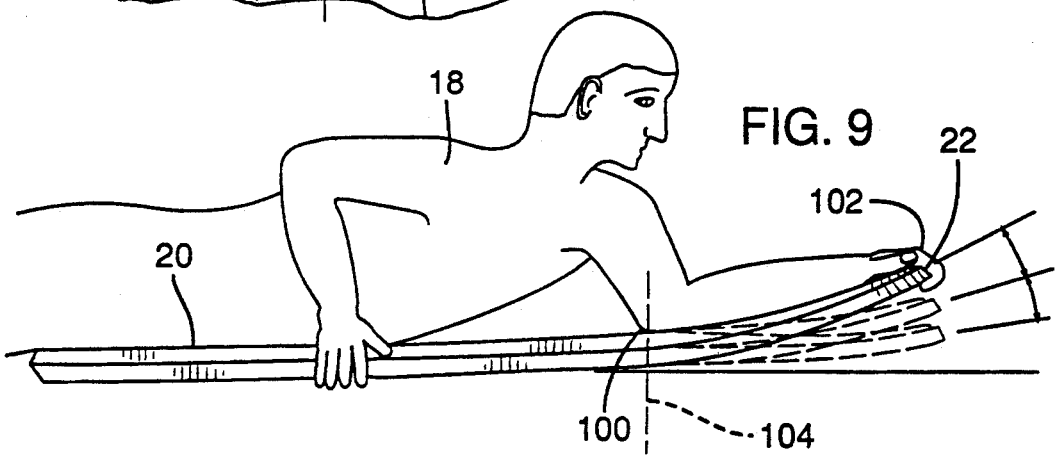
FIG. 9
FIG. 10
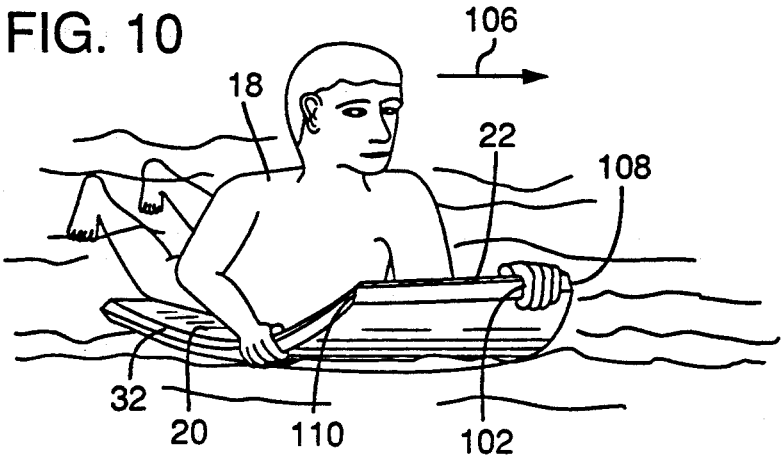

BODYBOARD WITH VARIABLE STIFFNESS

BACKGROUND AND SUMMARY OF THE INVENTION

This patent application is a continuation-in-part of patent application Ser. No. 07/638,835, filed Jan. 4, 1991, which issued as U.S. Pat. No. 5,114,370, entitled BODYBOARD WITH VARIABLE STIFFNESS, invented by Steven Michael Moran.

The invention relates generally to sporting goods and recreational products, and more particularly to an improved bodyboard for use in riding ocean surf.

Bodyboards are devices used for riding the waves on the seashore, somewhat akin to surfboards. In form, a bodyboard is a contoured, elongated foam plank covered with an outer skin which, on the bottom of the board, is generally slick and somewhat stiff for enhancing planing on the surf.

Bodyboards are traditionally ridden in a prone or procumbent position, with one arm extending forwardly for gripping the nose and the other arm positioned in a trailing manner for gripping the side edge of the board. With the arms and hands thus positioned, the rider can push or pull against the engaged front or side edges to control the attitude of the board in the surf to steer and maneuver. The rider's legs, which trail the board, also help in maneuvering.

The stiffness or rigidity of a bodyboard can affect its riding and control characteristics. For example, a highly rigid or stiff board tends to have greater speed than a board which is soft or easily bendable. A stiff board maintains its shape, has less drag and is more suited to use in surf with larger waves because the board's stiffness will help it to keep its shape when exposed to greater wave forces. A soft, flexible board is more controllable than a stiff board because its shape can be twisted and turned to increase friction and drag on selected parts of the board, which assists in steering and maneuvering. Soft boards tend to be used in lighter surf where wave forces are weaker, enabling the rider to make sharper turns.

It would be advantageous for a bodyboard to include the speed characteristics of a stiff board and the controllability of a soft board. In particular, a bodyboard with such a mixture of characteristics would be desirable in moderate-surf regions where speed could be enhanced without sacrificing control. The present invention provides both excellent planing characteristics and control by providing for regions of different stiffness over the length of the board. In particular the invention provides a variable flexure bodyboard in which one portion of the length of the board, constituting approximately the rear two-thirds to four-fifths of the board, is stiff relative to the nose of the board. The variation in the flexure characteristics of the board is provided by a combination of reinforcing stiffening devices in the stiff portion of the board and bendability-enhancing channels in the unstiffened nose portion of the board.

It is an object of the present invention to provide a bodyboard having different flexure and stiffness characteristics over selected predetermined regions of the board.

It is another object of the invention to provide a bodyboard in which the forward portion of the board, adjacent the nose, has enhanced flexibility and bendability yet is resistant to the formation of permanent creases or bends.

It is another object of the invention to provide a bodyboard which has the maneuverability of a relatively soft bodyboard and the speed of a relatively stiff bodyboard, due to selective stiffening of portions of the board.

Accordingly, the invention provides a bodyboard comprising an elongated, semi-rigid board structure which extends between a front nose end and rear tail end. The board structure has relatively less stiffness in a front portion of the board, adjacent the front end, and relatively greater stiffness in a second portion of the board extending generally rearwardly from the front portion. As a consequence, the front portion of the board has greater flexibility and bendability relative to the second portion of the board.

In its preferred form, the board structure includes a bottom skin which provides a planing surface and a top skin which provides a riding surface. Semi-rigid foam forms the major structural element between the top and bottom skins. Means are provided for stiffening a major portion of the length of the board from a region adjacent the tail to a region forward of the midpoint of the board, the midpoint being midway between the nose and tail ends. The stiffened portion, also referred to as the second portion of the board, incorporates the means for stiffening within the layered structure of the board. The stiffening means inhibits flexure and bending of the portion of the board in which it is installed. A forward bendable portion of the board, extending approximately from a region adjacent the nose end to the front edge of the stiffened portion, is unstiffened and relatively more flexible than the stiffened portion of the board. The unstiffened forward portion of the board facilitates bending and flexure of the region adjacent the nose.

In its preferred form, the means for stiffening is employed to stiffen approximately the rear two-thirds to four-fifths of the board by means of fiber mesh selectively embedded between the top skin and the semi-rigid foam core and between the bottom skin and the semi-rigid foam core. The bendability of the forward portion of the board is preferably enhanced by means of a plurality of parallel channels formed in the foam beneath the top skin of the board. The channels are arcuate and extend laterally across the board, arching toward the nose of the board. Such channels increase the bendability of the portion of the board in which they are formed while inhibiting permanent creasing of the board during use.

BRIEF DESCRIPTION OF THE DRAWINGS

FIG. 8 is a partial top plan view of a rider on a schematic representation of the bodyboard illustrating how the nose and side are gripped by the rider, as in FIG. 1.

FIG. 9 is a side elevation of the board and rider of FIG. 8 illustrating adjustment of the forward rocker by the rider.

FIG. 10 is a perspective view of the front of the rider and board shown in FIGS. 8 and 9 illustrating how the nose is selectively bent to assist in steering and maneuvering.

DETAILED DESCRIPTION OF THE PREFERRED EMBODIMENT

Figure 1:
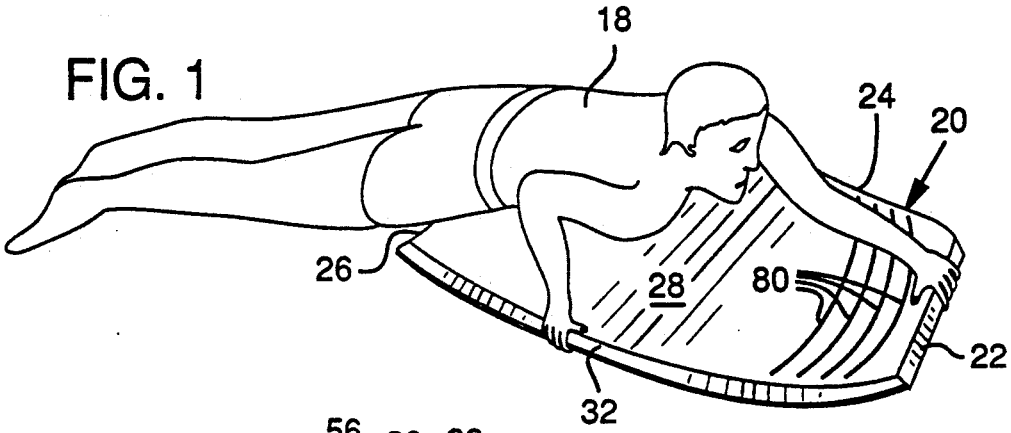
FIG. 1 is a perspective view of a bodyboard rider positioned on a bodyboard of the present invention, the illustrated riding position being typical for prior art bodyboards as well as for the bodyboard of the present invention.

FIG. 1 shows a bodyboarder 18, also referred to as a bodyboard rider 18, riding a bodyboard 20 in a typical riding position. One arm is extended forwardly gripping the nose end 22 of bodyboard 20 while the other arm is disposed in a trailing manner for engaging side rail 32. Rider 18 is on his stomach, in a prone or procumbent position, and is propped up on the elbow of the forward arm with his chest and torso overlying the board and his waste at or near the tail end 26 of the board. In this position, the rider steers or maneuvers the board by leaning, use of his legs, and manipulation of the board. The structure of board 20 includes a relatively flexible, bendable nose portion adjacent nose end 22, with the remainder of the board being relatively stiff. The construction of board 20 provides for variable or differential flexibility over the length of the board, in accordance with the present invention.

Figure 2:
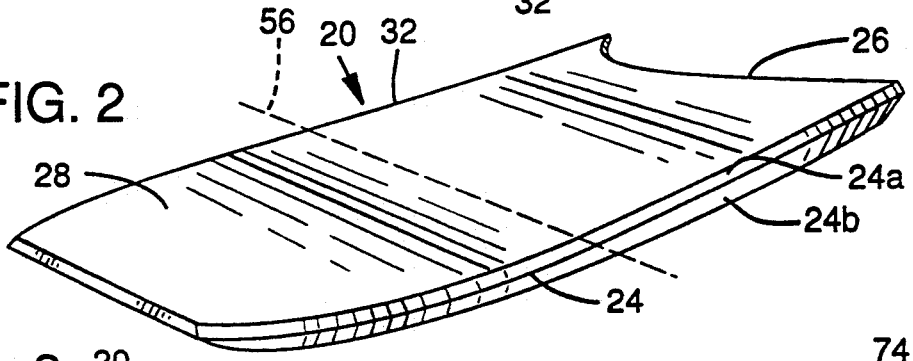
FIG. 2 is a perspective view of the bodyboard of the present invention as viewed from the front left corner of the bodyboard.

Referring to FIG. 2, bodyboard 20 is an elongate, substantially planar board having a top surface or skin 28, a bottom surface or skin 30, a nose or forward end 22, a tail or back end 26 and left and right side longitudinal, laterally-opposed edges 24, 32, respectively. The side edges are beveled and include, on the left side, a top beveled edge surface 24*a*, called a chine, and a bottom beveled edge surface 24*b*, which incorporates the left side rail of the board. Equivalent top and bottom beveled surfaces 32*a*, 32*b* are provided on right side edge 32 (see FIG. 4A).

Figure 3:
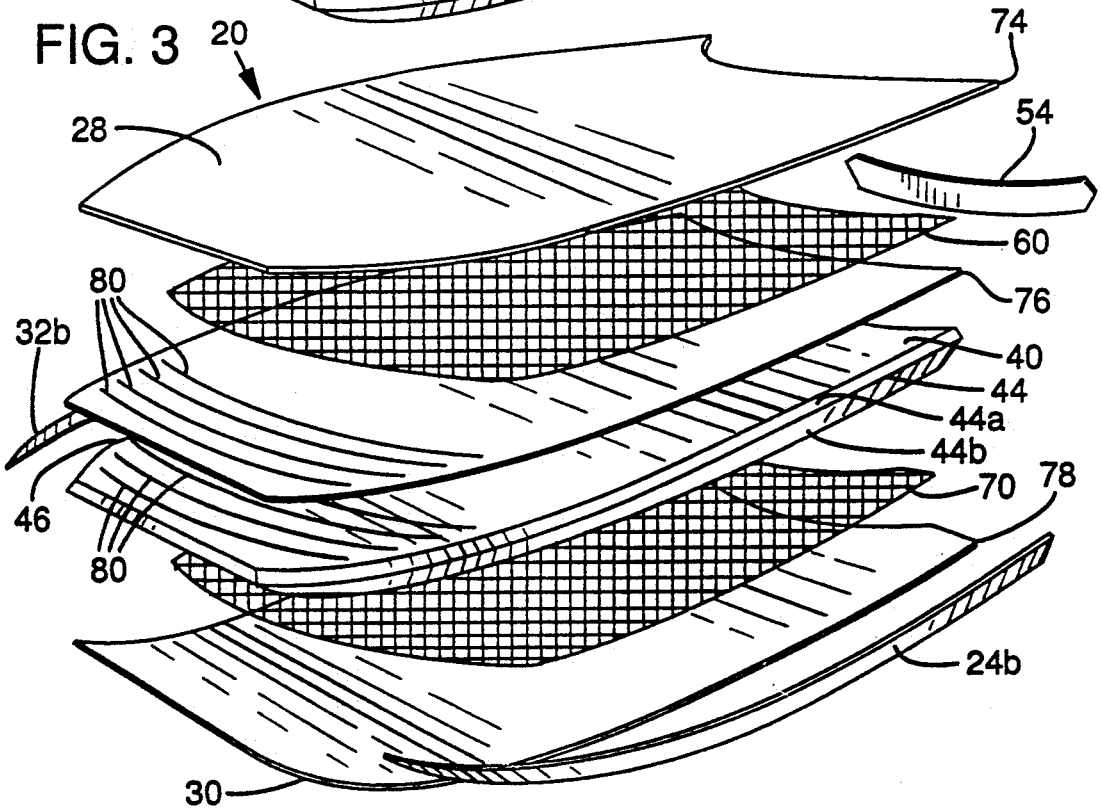
FIG. 3 is an exploded perspective view of the parts of an assembled bodyboard as in FIG. 2, illustrating the various layer and elements in the construction of the bodyboard.

FIG. 3, which shows an exploded view of the bodyboard of FIG. 2, illustrates the internal and external construction of the board. At the center of the board, forming the majority of the volume of the board, is an inner core 40 of foam of a type specially fabricated for use in bodyboards called Wavecore (trademark). It is a high quality Ethafoam ® product made by Dow Chemical Co. Foam core 40 is relatively stiff and dense and, although resiliently deformable, will tend to retain its shape and define the overall shape of the bodyboard. In a typical board of approximately 4-feet in length, foam core 40 will be 2-inches to 3-inches in thickness at the midportion of the board and will taper downwardly to a smaller thickness adjacent nose end 22. The longitudinal sides 44, 46 of the core taper toward one another adjacent nose end 22. A forward-arching concave indentation is formed in tail end 26, defining what is known as a swallow tail.

Core 40 curves upwardly from the midpoint of the board toward the nose and tail ends, defining nose and tail rockers, which form upwardly curving planing surfaces on the bottom of the board. The longitudinal sides 44, 46 and nose and tail ends of the foam core are beveled. Left side edge 44 of core 40 includes upper beveled edge 44*a*, which forms the chine, and lower beveled edge 44*b*, which supports the side rail 24*b* (FIG. 3), and right side edge 46 includes upper beveled edge 46*a*, which forms the chine, and lower beveled edge 46*b*, which supports the other side rail 32*b* (FIG. 4A).

Overlying foam core 40 is an intermediate structure, which includes the stiffening means of the present invention, described below, and a top skin 28 preferably formed of a foam such as Ethafoam ®. Top skin 28 covers both the entire top surface of the bodyboard and the chines 24*a*, 32*a* (see FIGS. 4A and 7). Bonded to the underside of foam core 40 is an intermediate stiffening layer, described below, and a bottom skin 30. The bottom skin is preferably formed of a high quality, friction-reducing covering such as Surlyn ®, made by Dupont. Bottom skin 30 is generally one-sixteenth inch or less in thickness and provides a hard, shiny surface which is tough and resilient. Longitudinal side rails, 24*b*, 32*b*, formed of foam such as Ethafoam ®, are bonded by thermolamination or another suitable technique to the underbeveled side edges 44*b*, 46*b* of foam core 40 (see FIGS. 3 and 4A) and form part of the side edges 24, 32 of the bodyboard. A laminated tail piece 54 is bonded to tail end 26.

One important feature of the present invention is the provision of stiffening means for increasing the stiffness of a major portion of the board between a region adjacent tail end 26 and a region forward of the midpoint 56 of the board. Midpoint 56 is located longitudinally midway between the front (nose) end 22 and rear (tail) end 26. The stiffened portion of the board, also referred to as the second portion, is the rear approximately two-thirds to four-fifths of the board, indicated in FIGS. 4 and 5 at 58. The preferred means for stiffening portion 58 of the board is the inclusion of one or more layers of stiffening material between the outer skin of the board and the foam core 40. The stiffening layers are laminated into the board structure intermediately between the foam core and the top skin and between the foam core and the bottom skin. In the preferred embodiment, these stiffening layers are relatively thin sheets or expanses of thermoplastic fiber mesh. Referred to alternatively as stiffening means, stiffening layers or stiffeners, the fiber mesh layers are laminated into the board structure in selected regions of the board to define the stiffened portion 58 of the board.

Upper stiffening fiber mesh layer 60 will be described first. Shown schematically in FIG. 4, upper mesh layer 60 is a sheet material made of thermoplastic filaments. The filaments are formed of polyethylene, polypropylene or a blend or composite which includes those materials. Alternatively, another suitable filament material which is strong and resilient could be used for forming mesh 60. A portion of the fiber mesh is shown in FIG. 4B. The mesh consists of spaced-apart fiber strands joined together at their intersection points to produce an open cross weave pattern. Each strand 62 of the fiber mesh has a size (diameter) in the range of approximately 0.02-inch to 0.1-inch, with the preferred diameter being approximately 0.043-inch. The spacing between the individual fibers is about 0.375-inch to 1.25-inch in the cross-hatched pattern of fiber filaments. The fibers shown in FIG. 4B are locked together at their intersection points 63 during fabrication of the mesh by thermomelting or a similar process. The mesh has an overall ratio of fiber thickness to mesh opening area 64 (which is the area between and enclosed by adjacent strands) in the range of between about 1-to-8 and 1-to-25. The preferred strand diameter/opening area ratio is approximately 1-to-15.

Figure 4:
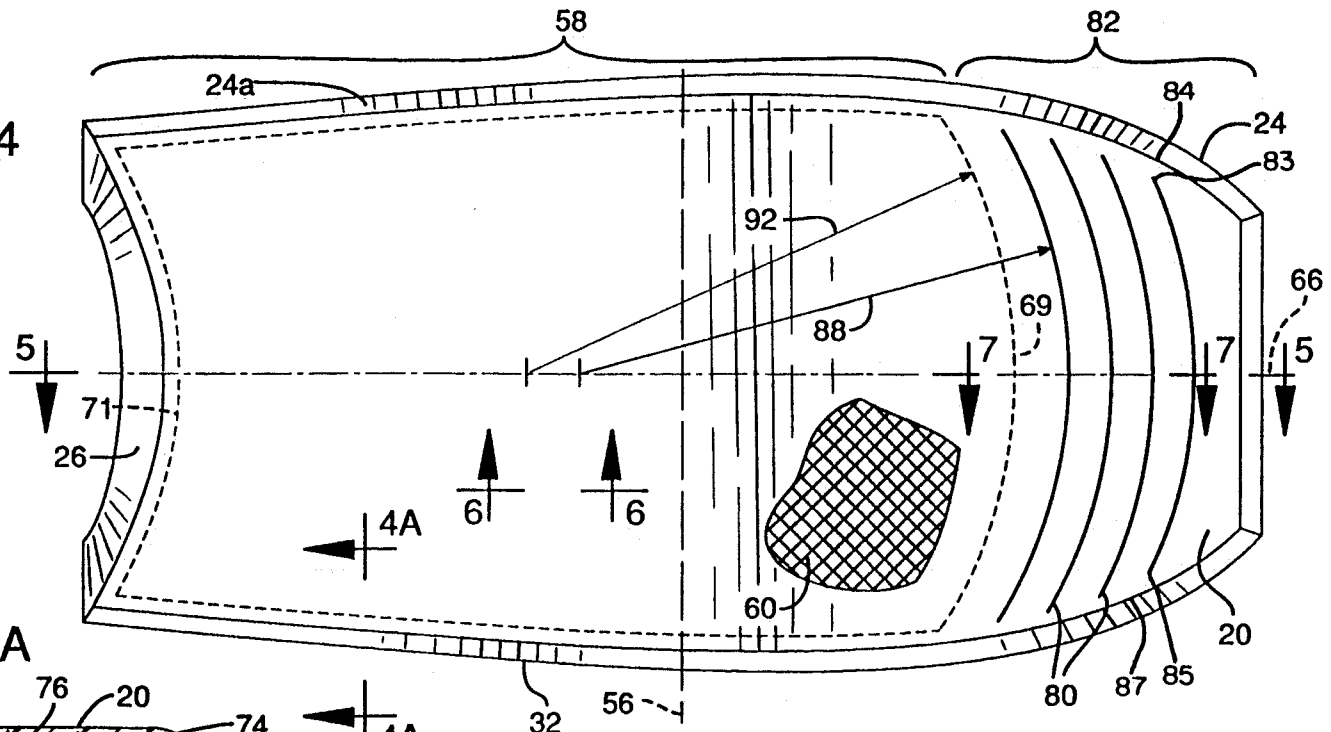
FIG. 4 is a top plan view of the bodyboard of FIG. 2, partially cut away, illustrating in phantom the relative positions of the reinforcing mesh and the bendability-enhancing channels.
Figure 4B:
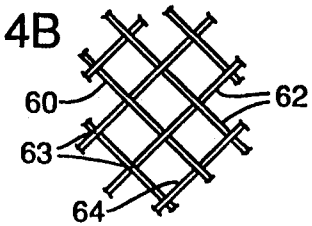
FIG. 4B is a perspective view, on an enlarged scale, of a portion of the fiber mesh reinforcing or stiffening layer employed in the preferred embodiment and shown schematically in FIG. 4.
Figure 4A:
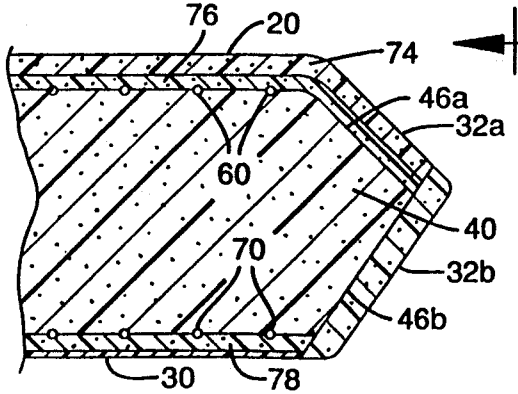
FIG. 4A is a side cross-sectional view on an enlarged scale taken along line 4A—4A of FIG. 4.

As shown in FIG. 4, the upper fiber mesh layer 60 extends over the generally flat top surface of the foam core and adjacent, but not over, the beveled longitudinal sides 24, 32 and beveled tail 26. The orientation of the individual fiber strands in mesh 60 is diagonal relative to the longitudinal center line 66 of board 20. Diagonal orientation allows for some flexure of the mesh in the longitudinal direction, parallel to center line 66, while inhibiting the formation of lateral creases in the board.

In addition to the upper fiber mesh layer 60, the means for stiffening region 58 of the board includes a lower fiber mesh layer 70, laminated between foam core 40 and bottom skin 30. The fiber strand size, strand size-to-mesh opening ratio and mesh orientation are the same for lower mesh layer 70 as for upper mesh layer 60. The overall longitudinal length of lower mesh 70 is equal to upper mesh 60. Together, the upper and lower mesh layers substantially stiffen portions of the bodyboard 20 by creating a box-type reinforced beam structure in the stiffened portion of the board. Because the mesh layers are anchored to the laminated structure of the board (as described below) in spaced-apart parallel relation to one another, they act like the parallel sides of a box girder, I-beam or similar structure, resisting bending forces acting on the structure.

Figure 5:
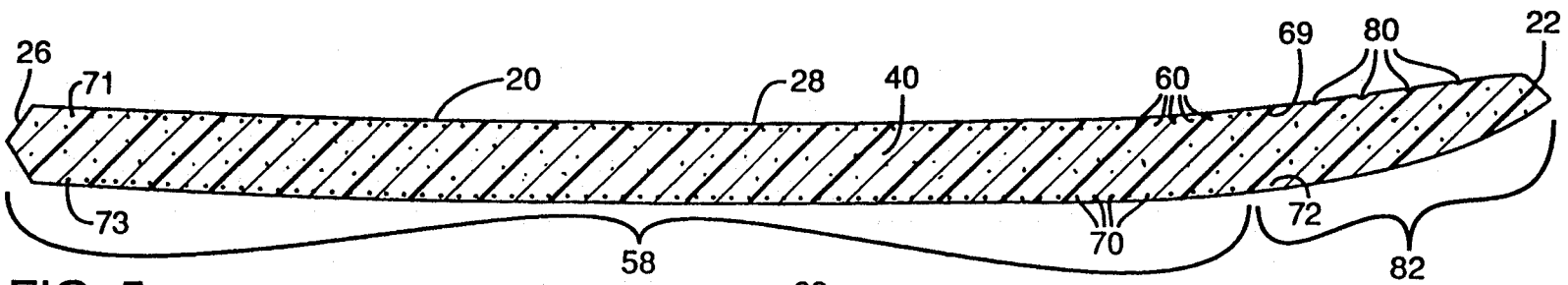
FIG. 5 is a side, cross-sectional, longitudinal view of the bodyboard taken along line 5—5 of FIG. 4.

As shown in FIGS. 4 and 5, the forward end 69 of upper mesh 60 is arcuate and arches toward the nose 22 of the board. The rear end of upper mesh 60 is at 71. The forward end 72 of lower mesh 70 is also arcuate and arches toward the nose 22. The rear end of lower mesh 70 is at 73. The upper and lower mesh layers are thus coextensive reinforcing elements in the laminated structure of the board.

Figure 6:
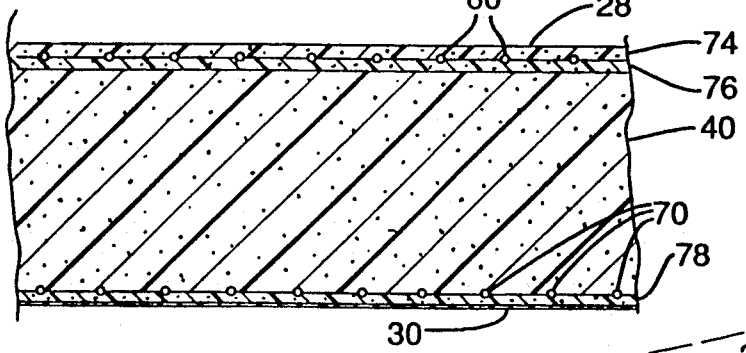
FIG. 6 is an enlarged cross-sectional view of a portion of the view shown in FIG. 5, taken between lines 6—6 of FIG. 4.

FIGS. 3 and 6 show the layered construction of bodyboard 20 in greatest detail. Upper reinforcing mesh 60 and lower reinforcing mesh 70 are laminated into the layered structure of board 20 between the foam core 40 and outer skin surfaces. Top skin 20, which is a thin sheet of Ethafoam ® or another suitable foam material, has a thickness generally between one-eighth-inch and one-quarter-inch. Referring to FIG. 6, top skin 28 is illustrated in cross-section as backed by and including foam layer 74. Another foam layer 76 having the same thickness as skin layer 74 is placed intermediate between upper foam layer 74 and core 40. Upper reinforcing mesh layer 60 is thermolaminated between the top skin foam layer 74 and adjacent intermediate layer 76, the latter being thermolaminated to foam core 40.

By sandwiching upper mesh layer 60 between two layers of Ethafoam ® 74, 76, the depth of the mesh layer beneath top skin 28 can be selected to control the depth of the mesh within the board structure. It might be desirable, for example, to locate upper mesh layer 60 close to the surface of top skin 28 so the mesh will form a noticeable pattern of ridges on the top of the board. That is accomplished by selecting a thin expanse of foam for layer 74. To bury mesh layer 60 further beneath top surface 28, a thicker layer of foam is selected for top skin layer 74. Intermediate layer 76 is optional and could be eliminated, positioning mesh 60 directly between top skin layer 74 and foam core 40, if desired.

Installation of reinforcing mesh 60 during fabrication of the board does not greatly alter the manufacturing steps for fabricating the layered board structure. In the manufacture of any laminated bodyboard structure, adjacent layers of Ethafoam ® are thermolaminated together to build up the board structure. That thermolamination process is also effective to join the adjacent layers together through the openings 64 in the fiber mesh. Consequently, during the bonding together of adjacent foam layers, the mesh is simply sandwiched between the adjacent layers of the Ethafoam ® and the fibers become embedded in the foam. Except for positioning the fiber mesh between adjacent layers before bonding, conventional thermolamination techniques for assembling the laminated board structure can be employed in constructing board 20.

The lower fiber mesh layer 70 is installed within the board structure in the same way as upper mesh layer 60. Bottom skin 30 consists generally of a dense, shiny sheet of Surlyn ® backed by a thin (i.e., less than one-quarter-inch thick) layer 78 of Ethafoam ®. Lower reinforcing mesh 70 is positioned between the Ethafoam ® backing layer 78 and the foam core 40 and is secured in place by thermolamination of the adjacent foam layers through the mesh openings 64, as described above.

FIG. 4A shows an enlarged cross-sectional view of the right longitudinal side edge 32 of board 20 and illustrates the side extent of upper and lower mesh layers 60, 70, respectively. It also shows the location of side rail **32*b* relative to the lower beveled edge 46*b* of foam core 40. Upper beveled edge 46*a*, termed the chine, is covered by side portions of intermediate foam layer 76 and top skin 20. A separate, laminated chine piece may additionally or alternatively be applied to upper beveled edge 46*a*, if desired. Side rails 24*b*, 32*b* may alternatively be formed of double laminated layers of Ethafoam ®, or the like, instead of the single laminated rail 32*b* shown in FIG. 4A**.

Figure 7:
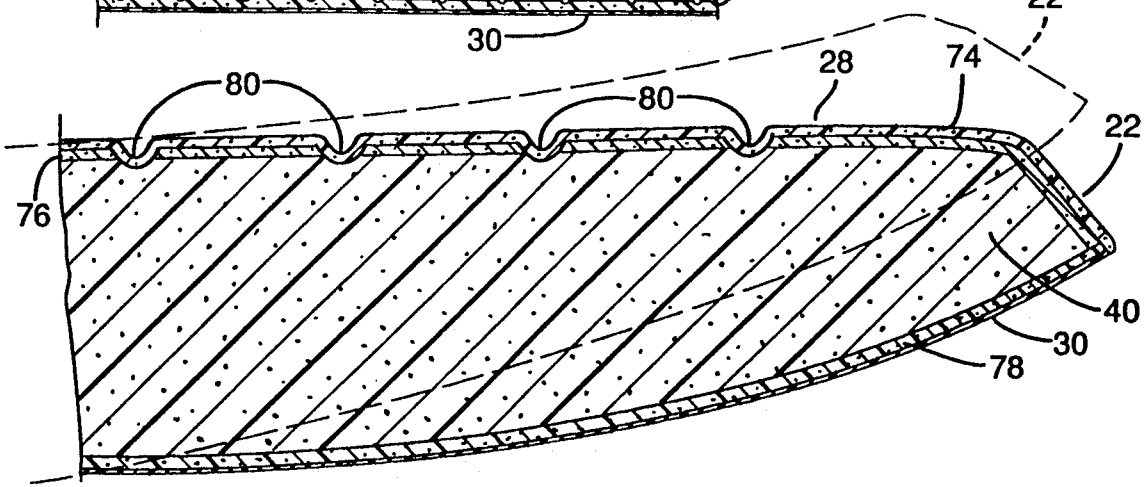
FIG. 7 is an enlarged, side cross-sectional view showing a portion of the nose of the bodyboard, taken along line 7—7 of FIG. 4, and indicating in phantom the bendability of the nose.

FIG. 7 shows a portion of the nose of board 20 in cross-section and illustrates the use of a preferred means for increasing the bendability of the forward portion of the board. One or more laterally-extending channels 80 are formed in the foam beneath top skin 28 in the forward or nose portion 82 (see FIGS. 4 and 5). Each channel includes a region of removed foam core material which serves to select the degree of flexibility of the forward portion of the board by increasing its bendability. Channels 80 are preferably formed by heat branding the laminated board structure after intermediate layer 76 is installed and before top skin layer 74 is installed. Heat branding employs elongated heated surfaces or devices to burn away, remove or permanently deform selected portions of the Ethafoam ® of layer 76 and of the foam core. The channels thus formed have a depth in the foam, beneath the top skin, of from about three-sixteenth-inch to about three-eighths-inch and a width of from about three-sixteenth-inch to about three-eighths-inch. The preferred width of the channels is ¼-inch and the preferred depth is 3/16-inch. The top skin layer 74, when installed, covers the channels, following the contours of the indentations formed by the channels to produce elongated indentations in top skin 28. Consequently, the channels are visible in the top skin.

The lateral extent of each channel 80 is from a region near one side edge to a region near the other side edge. Referring to FIG. 4, the laterally-extending elongate indentations which define channels 80 in the foam beneath top skin 28 do not extend all the way across the width of the forward portion of the board. Instead, each channel extends from a point spaced from one side edge to a point spaced from the other side edge. Considering the channel closest to nose 22, it extends from a point 83 approximately one-half-inch in from the top corner 84 of beveled left side edge 24 to a point 85 approximately one-half-inch in from the top corner 87 of right beveled side edge 32.

From FIGS. 3 and 4 it can be seen that channels 80 are arcuate, arching toward the nose of the board. Each channel includes a segment of generally circular arc which is centered generally along central longitudinal axis 66. Radius line 88 in FIG. 4 illustrates the arcuate center of the most rearwardly of channels 80. The channels are preferably approximately 1-inch to 1½-inches apart. Four channels are shown in the preferred embodiment, each generally parallel with one another. The channels may be concentric, each having a different radius centered at the same point, or they may have equal radii with the center of each arc located at regular intervals along the central axis 66 of the board. In either configuration, the spacing and arcuate shape of channels 80 minimizes regions of stress concentration and causes the corners of the nose to flex generally toward the center of the board, located at the intersection point of central axis 66 and the middle lateral axis 56. As explained below, centrally-directed flexure of the nose helps the rider control the board by facilitating movement of the nose in the most advantageous direction for steering and maneuvering. The arcuate shape, length and size of channels 80, and the spacing between channels, together serve as a means for minimizing regions of stress concentration in the nose region of the board when the nose is bent upwardly, preventing damage to the board structure during use.

FIG. 7 illustrates, in phantom, how the forward bendable portion of the board can be bent upwardly in a direction transverse to the longitudinal axis 66 of the board. Although not a great amount of material is removed or burned away in scoring the pattern of channels in the board structure, it is sufficient to substantially increase the flexibility or bendability of the board in the localized region near the channel. As the nose is bent upwardly, the opposed inside surfaces of each channel move closer together, which removes some resistance to flexure of the board structure. Outside of the immediate vicinity of each channel 80, including the spaces between the channels, the board structure is not bendability-enhanced. The result is segmented flexibility, meaning board has segments of enhanced flexibility separated by relatively less flexible segments. Use of such segmented flexibility, together with the arcuate shape of the channels, inhibits the formation of permanent creases or fractures in the body of the board and helps the nose bend in a gentle, gradual curve, rather than developing an abrupt edge.

Because the board is constructed differently in different regions, its stiffness or bendability varies over the surface and length of the board. The major portion of board 20, in region 58, extending from adjacent tail 26 to a region forward of midpoint 54 of the board, is reinforced and stiffened with layers of fiber mesh to increase the stiffness of the board structure. The remainder of the board, extending generally forward of the stiffened portion, is unstiffened and relatively flexible. Front portion 82 encompasses between approximately fifteen percent and forty percent of the length of the board. Bodyboard 20 thus combines the structure of a stiff board in those rear portions of the board which are generally submerged and tend to support the rider, and the structure of a soft, flexible board in the nose region, which is generally out of the water and used for controlling and maneuvering the board.

FIGS. 1, 8, 9 and 10 illustrate how a typical rider 18 makes use of the board and explains part of the rationale for the position and shape of the reinforcing mesh. During normal use, rider 18 is in the position shown in FIGS. 1 and 8, with one hand gripping the nose 22 and the other hand gripping the side rail. The rider will be resting some of his forward weight on the forward-extending arm, at the elbow 100. If the rider wishes to increase the curvature of the front of the board, to raise the nose rocker, his forward hand 102, gripping the nose 22 of the board, pulls upward and backward in a levering action, with elbow 100 acting as an anchor or fulcrum point. That action applies substantial pressure to the top of the board beneath the rider's elbow. For that reason, upper reinforcing mesh layer 60 preferably extends generally from adjacent the tail end of the board to a point forward of the elbow 100 of rider 18 shown in FIGS. 8 and 9. Considering human anatomy, the 95th percentile for the distance between the back of a rider's elbow 100 and the nose 22 of a bodyboard gripped by forward hand 102, is approximately 18-inches. Accordingly, upper reinforcing mesh layer 60 is designed to extend forward of a line 104 (indicated in phantom in FIG. 8) approximately 18-inches back from nose 22. Line 104 is the rider's "elbow line" where the elbow of the forward-extending arm will most likely be positioned when the rider is in a typical riding position shown in FIGS. 1 and 8–10. Mesh layer 60 extends forwardly to the region of "elbow line" 104, establishing the bendable nose portion forward of the "elbow line" region. The bendable nose portion is the portion of the board that is bent and flexed by the rider's forward-extending arm to maneuver the board. Preferably, mesh layer 60 extends forward of line 104 to approximately 8-to-12-inches from nose 22. That allows the forward part of the reinforcing mesh to reinforce the board at the point of maximum pressure exerted by the rider's elbow. The forward end of upper mesh 60 is indicated by dashed line 69. The bendability-enhancing channels 80 are positioned between the forward end 69 of mesh 60 and nose 22, in region 82.

To control the speed or maneuver the board while riding the surf, rider 18 selectively adjusts the height of nose 22 in the manner shown in FIG. 9. By raising nose 22, the rider bends the forward portion of the board along an axis generally transverse to the longitudinal axis 66 of the board, generally parallel with channels 80. Raising the nose relative to the rest of the board helps prevent the nose from burying in the water. To effect a turn, the rider will grasp one corner of nose 22, as shown in FIG. 10, and lean in the direction of the turn, which in FIG. 10 is left. By raising the left forward corner 108 slightly, rider 18 helps prevent the corner from burying itself into the water as the rider leans in direction 106. It also allows the rider to make small but important changes in the shape of the forward rocker, which is approximately the underside of forward portion 82, to help in cornering as well as in other maneuvers such as 360-degree turns. To effect a right turn, rider 18 will usually switch hand positions from that shown in FIGS. 1, 8, 9 and 10, moving the right arm forward to grasp the right forward corner 110 of the board. With the left arm trailing, the rider's left hand can grip the left side 32 of the board.

The arcuate shape of channels 80, each having a radius along central axis 66 of the board (see FIG. 4), helps both to prevent lateral creasing of the board and helps direct the flexure of the nose toward the center of the board. Wherever the rider grasps and pulls on nose 22, the curvature of the channels 80 automatically directs the bending force toward the center of the board, producing bending movements which are most helpful in controlling the board. The forward line 90 of the upper stiffening mesh, being parallel with arcuate channels 80, also assists in directing the flexure of the nose toward the center line of the board.

The variable stiffness bodyboard of the present invention has the maneuverability advantages of a soft bodyboard and the speed of a stiff bodyboard. It maximizes maneuverability by providing a predetermined, bendable or flexible region in the portion of the board adjacent the nose, where manipulations of the bodyboard's shape and contours are most useful in maneuvering. The result is a bodyboard which is very nearly, if not equally, as maneuverable as a relatively soft, flexible board, but which has substantially less drag. The invention allows the manufacturer to select the degree of stiffness in the stiff regions and the degree of bendability or flexibility in the bendable regions of the board. The size and shape of the stiffened portion or portions of the board can be readily and precisely controlled since the stiffened area conforms to the shape and position of the mesh in the laminated structure, which can be readily shaped prior to fabrication of the board. Similarly, a greater or lesser number of flexibility-enhancing channels can be applied in various regions of the board to meet the design and maneuverability goals of the board architect. Or the depth, width or spacing of the channels could be adjusted to meet performance objectives.

Alternative bodyboards incorporating the variable stiffness/bendability features of the variable flexure bodyboard are possible within the scope of the present invention. For example, bodyboards having different shapes, grip-enhancing surfaces, lengths or sizes could accommodate the customized flexure design of the present invention. Bodyboards requiring only a small increase in stiffness could employ only a single stiffening mesh layer. Alternatively, to further enhance stiffness, three or more stiffening layers could be built into the structure. Alternative configurations of the stiffening means could be used. For example, laminated sheets or strips of hard, relatively stiff material might be substituted as the stiffening device in place of, or together with, the open-weave mesh. Other means for increasing the bendability of the board, within the scope of the present invention, might include discontinuous channels, slots or openings extending into the foam core of the board. Channels could be formed adjacent the bottom surface of the board as well as, or instead of, the channels formed adjacent the top surface. Such alternative bendability-enhancing structural features should preferably include designs which minimize regions of stress concentration to prevent permanent creasing, like the arcuate shape and length of the channels in the preferred embodiment. Another alternative construction would be to heat brand the channels directly into the top skin, rather than beneath the top skin.

Yet another alternative construction within the scope of the present invention is to selectively stiffen regions of a relatively soft board, leaving the forward region adjacent the nose of the bodyboard unstiffened. Bendability enhancing features could be omitted, with only selective stiffening used to produce differential stiffness. The result of omitting bendability-enhancing elements would still be a substantial difference in flexibility and bendability of the forward region adjacent the nose, relative to the stiffened remainder of the board. These and other alternative bodyboard constructions incorporating regions of increased and decreased flexibility or bendability along the length of the board are within the scope of the present invention.

The present invention provides a bodyboard having different flexure and stiffness characteristics over selected predetermined regions of the board. It additionally provides a bodyboard in which the forward portion of the board, adjacent the nose, has enhanced flexibility and bendability yet is resistant to the formation of permanent creases or bends. The invention also provides a bodyboard which has the maneuverability of a relatively soft bodyboard and the speed of a relatively stiff bodyboard, as a result of selected stiffening of portions of the board.

While the present invention has been shown and described with reference to the foregoing preferred embodiment, it will be apparent to those skilled in the art that other changes in form and detail may be made without departing from the scope and spirit of the invention as defined in the appended claims.

What is claimed is:

1. A bodyboard for supporting a rider during travel in ocean surf comprising:

an elongate, semi-rigid board having top and bottom surfaces, a front nose end, a rear tail end and an inner core filled predominately with semi-rigid foam, and stiffening means for establishing a stiffened portion of the board extending generally from adjacent the tail end forwardly to the region where a rider's elbow generally is located when in a prone riding position with an arm extended forward to grasp the nose end, the board having a nose portion forward of the stiffened portion encompassing between approximately 15 percent and 40 percent of the length of the board, the nose portion of the board being flexible relative to the stiffened portion enabling the rider to bend the nose portion to maneuver the board as it travels in ocean surf.

2. A bodyboard comprising:

an elongate board extending between a front nose end and a rear tail end and having a bottom skin which provides a planing surface, a top skin which provides a riding surface, and including semi-rigid foam therebetween, means for stiffening a major portion of the length of the board from a region adjacent the tail end to a region forward of the midpoint between the nose and tail ends for inhibiting flexure and bending of the stiffened portion of the board, a forward bendable portion of the board extending from a region adjacent the nose end to the stiffened portion, the forward bendable portion being unstiffened and relatively more flexible than the stiffened portion of the board, and including a pattern of scoring of the semi-rigid foam to establish a plurality of generally parallel channels in the semi-rigid foam beneath the top skin, the channels extending laterally across a major portion of the width of the board in the forward bendable portion to increase the bendability of the forward bendable portion.

3. A bodyboard as in claim 2, the board including elongate, laterally opposed side edges extending from the nose to the tail, the parallel channels being arcuate, arching toward the nose of the board, and the channels extending into the foam beneath the top skin from a region near one side edge to a region near the other side edge.

4. A bodyboard as in claim 2 in which the board includes side edges extending from the nose end to the tail end and each channel extends laterally from a point spaced from one side edge to a point spaced from the other side edge.

5. A bodyboard as in claim 4 in which the channels are arcuate, each channel arcing toward the nose of the board, and each channel including a segment of a circular arc which is centered generally along the central longitudinal axis of the board.

6. A bodyboard as in claim 4 in which each channel has a depth in the foam beneath the top skin of between about one-twenty-fifth and four-tenths the thickness of the foam in the forward bendable portion of the board.

7. A bodyboard as in claim 6 in which the pattern of scoring of the semi-rigid foam to establish a plurality of generally parallel channels in the semi-rigid foam further includes means for minimizing regions of stress concentration, whereby creasing of the forward bendable portion is inhibited.

8. A bodyboard comprising:

an elongated board extending between a front nose end and a rear tail end, including side edges extending longitudinally from the nose end to the tail end, and having a bottom skin which provides a planing surface, a top skin which provides a riding surface, and semi-rigid foam therebetween, means for stiffening a major portion of the length of the board from a region adjacent the tail end to a region forward of the midpoint between of the stiffened portion of the board, the board having a forward bendable portion extending from a region adjacent the nose end to the stiffened portion, the bendable portion being unstiffened and relatively more flexible than the stiffened portion of the board, the forward bendable portion including a pattern of scoring of the semi-rigid foam beneath the top skin for increasing the bendability of the forward bendable portion, the pattern of scoring including a plurality of spaced apart, generally parallel channels extending across a major portion of the width of the forward bendable portion from a point spaced from one side edge to a point spaced from the other side edge, each channel having a depth in the foam beneath the top skin of from about three-sixteenth-inch to about three-eights-inch and a width of from about three-sixteenth-inch to about three-eights-inch, the spacing between adjacent channels being from about 1-inch to about 1½-inches, and the channels being arcuate, arching toward the nose of the board, whereby the spacing, length and shape of the channels inhibit localized concentrations of stress when the forward bendable portion is flexed.

9. A bodyboard for supporting a rider during travel in ocean surf comprising:

an elongated, semi-rigid board having top and bottom surfaces, a front nose end, a rear tail end, and an inner core filled predominately with semi-rigid foam, stiffening means for establishing a stiffened portion of the board extending generally from adjacent the tail end forward to the region where a rider's elbow generally is located when in a prone riding position with an arm extended forward to grasp the nose end, the board having a nose portion forward of the stiffened portion, the nose portion being flexible relative to the stiffened portion enabling the ridge to bend the nose portion to maneuver the board as it travels in ocean surf, and the stiffening means including a layer of stiffening material in the stiffened portion of the board laminated into the board structure, the stiffening layer including a forward edge closest to the nose end of the board in the region where a rider's elbow generally is located when in a prone riding position, the forward edge of the stiffening layer being arcuate, arching toward the nose end of the board.

10. A bodyboard as in claim 9 in which the layer of stiffening material includes a sheet of fiber mesh formed of spaced-apart thermoplastic fibers having a ratio of fiber thickness-to-fiber spacing in the range of between about 1-to-8 and 1-to-25.

11. A bodyboard as in claim 10 in which the orientation of the fibers in the fiber mesh is diagonal relative to the longitudinal center line of the board.

12. A bodyboard for supporting a rider during travel in ocean surf comprising:

an elongate, semi-rigid board having top and bottom surfaces, a front nose end, a rear tail end, and an inner core filled predominately with semi-rigid foam, including a top skin on the top surface of the board and a bottom skin on the bottom surface of the board, and stiffening means for establishing a stiffened portion of the board extending generally from adjacent the tail end forwardly to the region where a rider's elbow generally is located when in a prone riding position with an arm extended forward to grasp the nose end, the board having a nose portion forward of the stiffened portion, the nose portion being flexible relative to the stiffened portion enabling the rider to bend the nose portion to maneuver the board as it travels in ocean surf, and the stiffening means including an upper layer of stiffening material in the stiffened portion of the board disposed between the foam core and the top skin, and a lower layer of stiffening material in the stiffened portion of the board disposed between the foam core and the bottom skin.

13. A bodyboard comprising:

an elongate board extending between a front nose end and rear tail end and including a bottom skin which provides a planing surface, a semi-rigid foam core, a top skin which provides a riding surface, and laterally-opposed side edges extending from the nose end to the tail end, the board including a stiffened portion encompassing a major portion of the length of the board from a region adjacent the tail end to a region forward of the midpoint between the nose and tail ends, the stiffened portion extending generally between the side edges of the board, the board structure in the stiffened portion further including a lower stiffening layer including thermoplastic fiber mesh laminated between the foam core and the bottom skin and an upper stiffening layer including thermoplastic fiber mesh laminated between the foam core and the top skin, and a plurality of generally parallel, arcuate channels extending into the foam beneath the top skin in the portion of the board forward of the stiffened portion for enhancing the flexure and bendability of the forward portion of the board, the channels extending laterally across the forward portion of the board from a point near one side edge to a point near the other side edge.

14. A bodyboard as in claim 13 in which the channels in the foam beneath the top skin in the forward portion of the board have a depth and spacing which is in the range of about one-twenty-fifth to four-tenths the thickness of the foam core, the thermoplastic fiber mesh used in the upper and lower stiffening layers is an open weave mesh having a ratio of fiber thickness-to-fiber spacing in the range of between about 1-to-8 and 1-to-25, and the orientation of the fibers in the fiber mesh is diagonal relative to the center longitudinal axis of the board.

15. A bodyboard as in claim 13 in which the lower stiffening layer includes a thin boundary layer of semi-rigid foam between the bottom skin and the fiber mesh, the fiber mesh being bonded between the boundary layer and the core, and the upper stiffening layer includes at least one thin boundary layer of semi-rigid foam, the fiber mesh being bonded between the top skin and the core.

16. A bodyboard as in claim 13 in which the upper stiffening layer has a forward end closest to the nose end of the board, the forward end of the upper stiffening layer being arcuate and approximately parallel with the arcuate channels in the forward portion of the board.

17. A bodyboard for supporting a rider during travel in ocean surf comprising:

an elongate, semi-rigid board having top and bottom surfaces, a front nose end, a rear tail end, and an inner core filled predominately with semi-rigid foam, stiffening means for establishing a stiffened portion of the board extending generally from adjacent the tail end forwardly to the region where a rider's elbow generally is located when in a prone riding position with an arm extended forward to grasp the nose end, the board having a nose portion forward of the stiffened portion, the nose portion being flexible relative to the stiffened portion enabling the rider to bend the nose portion to maneuver the board as its travels in ocean surf, and a plurality of channels formed in the foam core, the channels being generally parallel and arcuate, arching toward the nose end of the board.

* * * * *